US006671901B2

(12) United States Patent
Zenczykowski

(10) Patent No.: US 6,671,901 B2
(45) Date of Patent: Jan. 6, 2004

(54) BED WITH A MOVABLY MOUNTED MATTRESS SUPPORT

(76) Inventor: Uta Zenczykowski, Fiefstücken 30, D-22297, Hamburg (DE)

( * ) Notice: Subject to any disclaimer, the term of this patent is extended or adjusted under 35 U.S.C. 154(b) by 0 days.

(21) Appl. No.: 10/181,026

(22) PCT Filed: Jan. 8, 2001

(86) PCT No.: PCT/EP01/00121

§ 371 (c)(1),
(2), (4) Date: Jul. 12, 2002

(87) PCT Pub. No.: WO01/50922

PCT Pub. Date: Jul. 19, 2001

(65) Prior Publication Data

US 2003/0000016 A1 Jan. 2, 2003

(30) Foreign Application Priority Data

Jan. 12, 2000 (DE) ..... 100 00 831

(51) Int. Cl.[7] ..... A47C 17/64
(52) U.S. Cl. ..... 5/118; 5/241; 5/239
(58) Field of Search ..... 5/244, 239, 118, 5/241, 242, 243, 309

(56) References Cited

U.S. PATENT DOCUMENTS 4,144,601 A * 3/1979 Anderson et al. ..... 5/118
5,598,591 A * 2/1997 Kelley ..... 5/118
6,003,178 A * 12/1999 Montoni ..... 5/690
6,493,886 B1 * 12/2002 Vanpage et al. ..... 5/118
6,505,362 B1 * 1/2003 Scipio ..... 5/118

FOREIGN PATENT DOCUMENTS

| | | |
|---|---|---|
| DE | 4300425 A | 7/1994 |
| DE | 4416689 C | 6/1995 |
| DE | 19633318 | 1/1998 |
| DE | 19654500 C | 3/1998 |

* cited by examiner

*Primary Examiner*—Teri Pham Luu
(74) *Attorney, Agent, or Firm*—Venable, LLP; John P. Shannon; Chad C. Anderson

(57) ABSTRACT

The invention refers to a bed with a mattress pad supported in a three-dimensionally movable manner and a bedstead with legs, which supports the mattress. The mattress pad is in springy or not springy, but yielding manner attached to the bedstead. Sensors are arranged spaced across the surface of the mattress pad, to detect the local lowering of the mattress pad during loading; and lifting means reacting to the local lowering also arranged spaced across the surface of the mattress pad between the mattress pad and the bedstead, to align the mattress pad in the horizontal disregarding the locally different loading. The sensors and the lifting means are formed as double-acting pressure cylinders, which are connected in cross-wise manner with regard to each other. (FIG. 1)

2 Claims, 3 Drawing Sheets

BED WITH A MOVABLY MOUNTED MATTRESS SUPPORT

The invention relates to a bed comprising a mattress pad supported in a three-dimensionally movable manner and a bedstead with legs, which holds the mattress pad.

Such a bed as a cot is known (DE-OS 24 52 086). In such a known bed, the mattress pad is movably supported in that the legs of the bed do not directly stand on the floor, but indirectly through springs. Such a bed has the considerable disadvantage that a child, when it moves towards one corner, for example, brings the mattress pad into a spatially inclined position such that not only the comfort of sleep suffers, but the child is also pressed to the bars or the bedsteads.

Furthermore, an adjustable swing couch is known, wherein a swinging frame is supported on four swinging stands and spring elements ensure that the swing couch can carry out swinging movements and that in several spatial axes (DE 43 00 425 C2 and DE 196 54 500 C1).

In a device for supporting the human body (DE 196 33 318 C1), pressure cylinders are provided at a support surface, which can be loaded such that the extendible telescopic part of the pressure cylinders adjusts to the outline of the human body.

It is the object of the present invention to design a bed of the type named above such that, disregarding the position assumed by the user in the bed, the mattress always returns into the horizontal plane.

This is achieved in that the mattress pads in a bed of the type named above are attached to the bedstead not in springy, but in yielding manner; sensors are arranged spaced across the surface of the mattress pad, to detect the local lowering of the mattress pad during loading; and lifting means reacting to the local lowering are also arranged spaced across the surface of the mattress pad between the mattress pad and the bed frame, to align the mattress pad horizontally disregarding the locally differing loads, the sensors and lifting means each being formed as double-acting pressure cylinder and connected in cross-wise manner with regard to each other.

One important feature for the invention is that several, preferably four sensors are provided, which react to the local lowering of the mattress pad and output a respective signal. This signal reaches the associated lifting means, which become active to align the mattress pad horizontally.

In the preferred embodiment of the bed according to the invention, the sensors and lifting means are formed as double-acting pressure cylinders connected in cross-wise manner to one another. In a further preferred embodiment, the pressure cylinders are each arranged in the area of each corner of the bed.

These pressure cylinders are the most simple type of a sensor and of a drive at the same time, when they are connected in crosswise manner with respect to each other. Thus, for example, the bottom outlet of a pressure cylinder is connected with the top inlet of the pressure cylinder arranged diagonally opposite, resulting in that the lowering in one corner of the bed is detected and this lowering is correspondingly counterbalanced.

With this construction of a cot, the behaviour in the phase before birth is considered after the birth. Characterising is that the level of the slatted frame, if it is supported in swinging manner, receives every movement of the child such that the child encounters the movements already known to her/him in the mother's body also after birth. It is important in this respect that it is not a movement transmitted from the outside to the sleeping plane, but that only the movements of the child are detected and a horizontal compensation is implemented.

The slight movements of the baby are also received and returned without the occurrence of a slanted sleeping plane. This is assured, for example, by the arrangement of cylinders or, alternatively, bellows at the slatted frame, which re-establish the horizontal position in every movement through hydraulics.

The first slatted frame level is preferably suspended at rubber loops in swinging manner with a spacing to the inner walls of the bed. In order to stabilise the position, a hydraulic combination, alternatively hydraulic bellows are arranged below—alternatively also above—the slatted frame, which hold the sleeping plane in the horizontal position in case of a weight shift to one side. It is thereby possible, to bed the child with straight back and in every position, without the need to do without calming swinging or rocking. This is supplemented by the fact that the child can determine him/herself, how strong the swinging is.

The bed comprising standard dimensions of a cot customary in the trade can be flexibly adjusted to the life and growth conditions of the child later. According to the increase in weight and size of the child, the slatted frame can be shifted to a different, arbitrarily chosen level. The parents can decide, whether the swinging level is kept or a fixed slatted frame is preferred. A pre-produced existing cover frame receives the smaller slatted frame of the top level. The fixing is implemented by the respective bores receiving the existing bolts, and then joins to the inner wall of the bed in flush manner.

The long sides and cross sides of the cot are covered securely against injury by a cover on the level of the slatted frame still supported in swinging manner during the first months of use. This cover is shifted downwards during a later age, and then forms a bedstead preventing the sliding off of blanket and pillow.

In a cot with swinging slatted frame according to the invention, vertical pegs are embedded on the upper wood of the frame in intervals of about 20 cm, which receive rubber loops. These rubber loops are pulled over the embedded pegs below the slatted frame. In this manner, the top slatted frame yields to every pressure applied to the surface. All pegs have a groove directly on the frame wood, which fix the rubber strips or rings, respectively, such that they cannot slip off. Below the frame wood, the rubber loops are secured additionally by a clamp such that slipping off can also be excluded in case of stronger movement.

The top cover frame, on which the pegs are attached, is attached to the end of the bed by a cover bar comprising opposing bores with two respective introduced bolts. The bolt heads prevent furthermore that the rubbers can be removed at an unwanted time.

In a cot with swinging slatted frame according to the invention, a hydraulic combination is arranged at the level of the swinging slatted frame, balancing each incline from the horizontal plane:

$1^{st}$ Possibility:

The hydraulic system consists of four cylinders, the chambers of which are separated in the centre. The cylinders are diagonally connected by a hydraulic line. The line connects the bottom chamber of the cylinders with the top chamber of the diagonally opposed cylinder. When pressure is exerted onto the one cylinder, the hydraulic liquid driven out of the bottom chamber of the one cylinder flows into the top chamber of the diagonally arranged cylinder. Thereby, the piston in both cylinders is moved downwards by the same stroke. This synchronous movement also occurs in that case—although in reversed direction—when the opposed cylinder is loaded by the movement of the child. The hydraulic cylinders are connected through a ball and socket joint with the frame wood and the support bearing of the cylinder. By this ball and socket joint the slatted frame can receive and pass on horizontal movements.

$2^{nd}$ Possibility

The hydraulic system consists of eight rolling bellows, four of which are arranged above and four below the slatted frame. The bellows are fixedly connected with the slatted frame and the associated bearing support. The respective top and bottom bellows diagonally opposing each other are connected with a hydraulic line. During one-sided loading of the bottom bellows, the top diagonal bellows is guided by the same stroke amount into the same direction by means of the pressure compensation, such that a stabilisation of position occurs through the mutually opposed stroke path. In this alternative, horizontal movements are received by the bellows and are directly transmitted to the slatted frame.

In a cot with swinging slatted frame according to the invention, the clearance between the inner edge of the bed to the outer edge of the slatted frame is covered with a lined cloth lining to a) optically decrease the size of the cot and to adjust it to the size of the child for the first month of the baby; and b) to close the open part up to the inner wall of the bed softly and safe against injury. This closing occurs by a double sheet of cloth filled with foamed material on the inside. The bottom level of the cloth sheet is attached to the casing of the slatted frame in hidden manner. The top part of the cloth sheet contains riveted rings inserted over the top pegs, similar to the rubber loops. As it is the case for the protection of the rubber loops, also the riveting rings are fixed and protected by the cover frame.

In a cot with swinging slatted frame according to the invention, the smaller slatted frame is received in a lower level by a cover frame, which can be shifted correspondingly. It is therefore not required to buy a new slatted frame. This cover frame incorporated already serves for the reception of the hydraulic piston or alternatively of the bellows during the child's first phase of life. After removal of the rubber loops as well as the hydraulics, the slatted frame is set on a level selected by own choice. The cover frame already contains the respective bores, into which the existing pegs of the slatted frame can be inserted. Thereby, the slatted frame is fixed then and cannot slip. The mattress comprising larger dimensions (70×1, 40 cm) forms the direct joint to the inner wall of the bed now.

The invention will be explained by way of example with reference to the drawing below.

Figure 1:
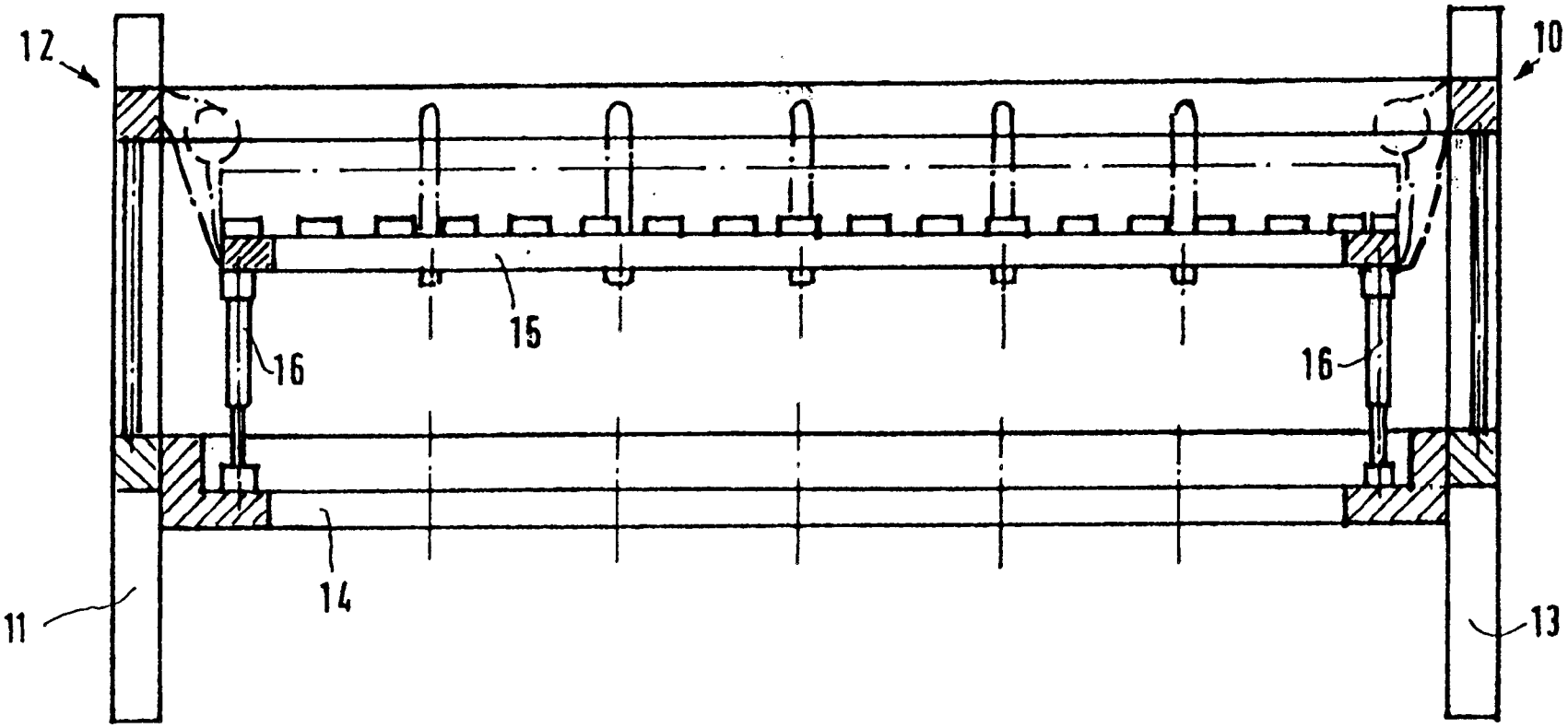
FIG. 1 shows a longitudinal cross-section through a bed according to the invention.

In FIG. 1, 10 and 12 indicate the two bedsteads at the front side, furthermore, two of the total four legs 11 and 13 can be recognised. Mounted on the bedstead is a frame part 14, which substantially complies with the cross-sectional form of the bed and onto which normally the slatted frame or a mattress pad is laid.

However, according to the invention, the mattress pad 15 is not directly attached to the bedstead or parts of the bedstead 14, but via piston cylinder arrangements 16 shown in the figure. A total of four such piston cylinder arrangements 16 is provided, and that in the corner areas of the bed.

Figure 2:
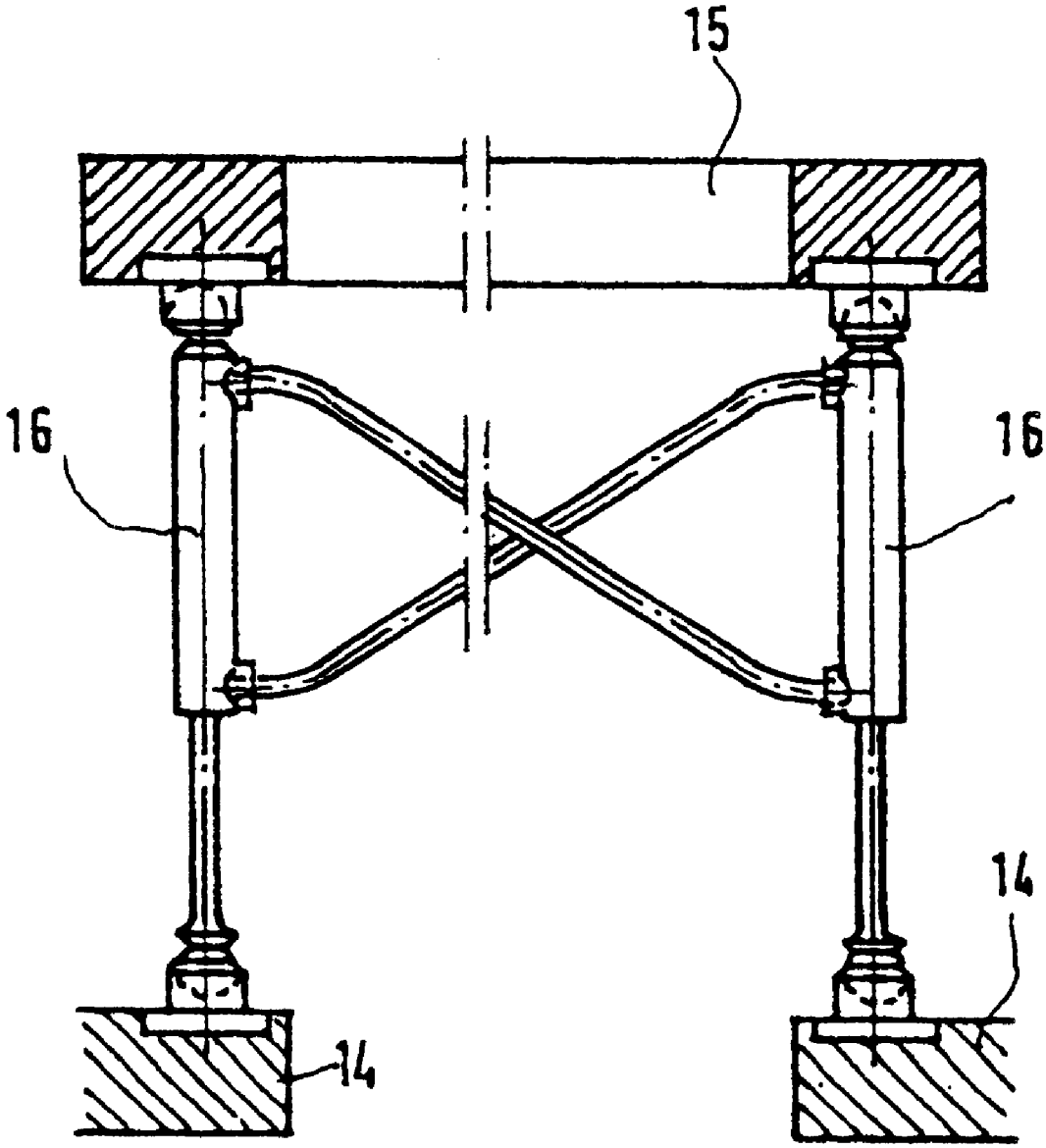
FIG. 2 shows on an enlarged scale details of the support of the mattress pad on parts of the bedstead.

It can be seen in FIG. 2, how the mattress pad 15 is attached to parts of the bedstead 14, that is via the two shown, double-acting piston cylinder arrangements 16. It can be taken from the line or pipe guiding that the piston cylinder arrangements 16 diametrically opposite to one another are switched in opposition.

Figure 3:
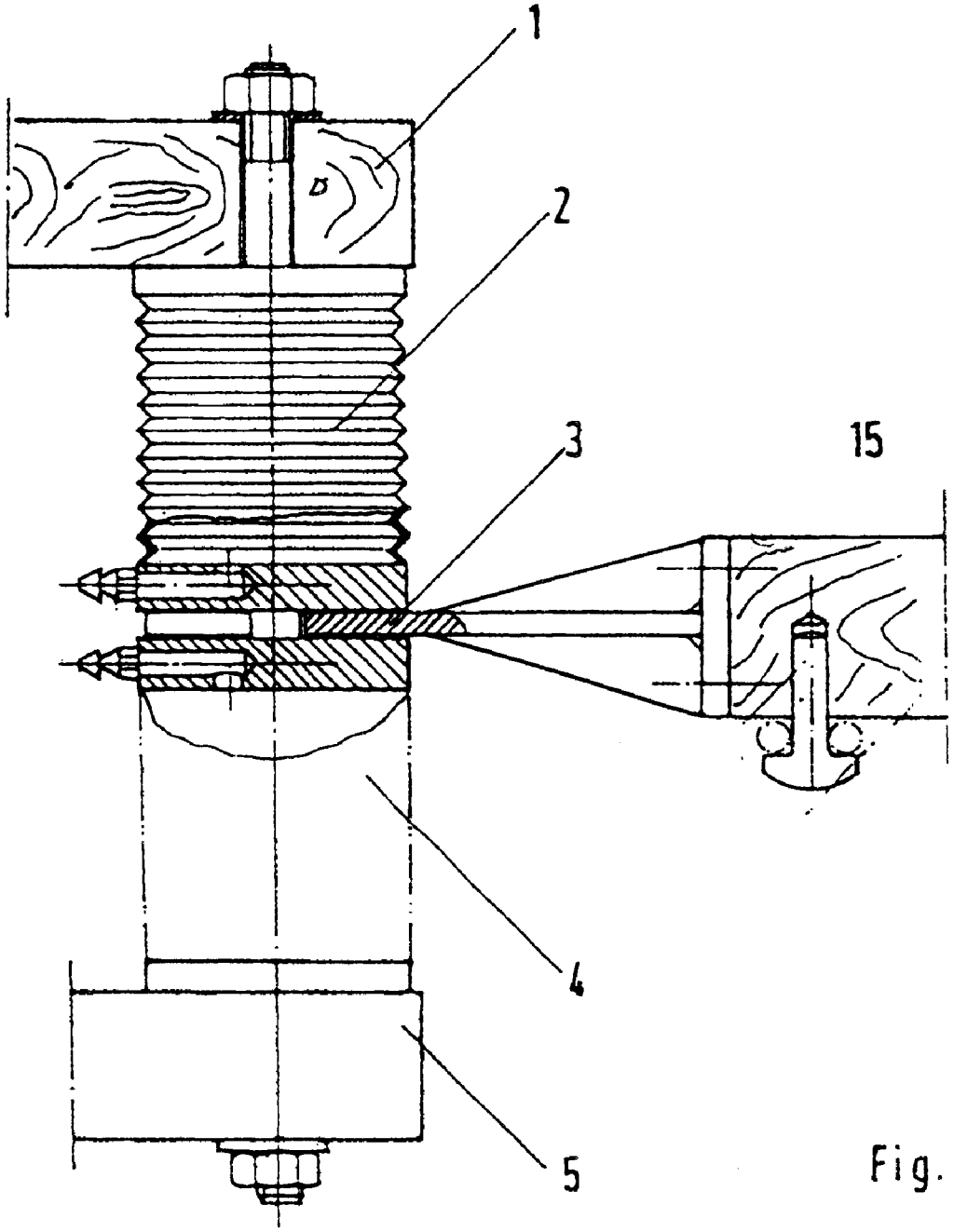
FIG. 3 shows on further enlarged scale details of a special embodiment of a support of the mattress pad.

Parts of the mattress pad 15 can be seen in FIG. 3 and it shows especially one embodiment, how this mattress pad 15 or the slatted frame, respectively, is attached to the parts of the bedstead, that is at the top support 1 and the bottom support 5. Namely, a slatted frame holder 3 is arranged between two bellows 2 and 4 such that the slatted frame casing 15 can perform movements directed upwards as well as downwards.

On the left-hand side of the figure, the pressure medium connections for the bellows 2 and 4 can be seen, and it will be recognised that by way of such an arrangement the controlled alignment of the slatted frame casing 15 into the horizontal plane is possible.

What is claimed is:

1. Bed comprising a mattress pad supported in a three-dimensionally movable manner and a bedstead with legs, which supports the mattress pad, characterised in that the mattress pad (15) is attached on the bedstead (10, 12) not in springy but yielding manner; that sensors (16) are arranged spaced across the surface of the mattress pad (15), to detect the local lowering of the mattress pad during loading; and that lifting means (16) reacting to the local lowering are also arranged spaced across the surface of the mattress pad between mattress pad (15) and bedstead (14), to align the mattress horizontally disregarding the locally different loading, the sensors and lifting means each being formed as double-acting pressure cylinders (16) and connected in cross-wise manner regarding each other.

2. Bed according to claim 1, characterised in that a pressure cylinder (16) is arranged in the area of each corner of the bed.

* * * * *